US007511216B2

(12) United States Patent
Clynes

(10) Patent No.: US 7,511,216 B2
(45) Date of Patent: Mar. 31, 2009

(54) SHAPING AMPLITUDE CONTOURS OF MUSICAL NOTES

(76) Inventor: Manfred Clynes, 19181 Mesquite Ct., Sonoma, CA (US) 95476

( * ) Notice: Subject to any disclaimer, the term of this patent is extended or adjusted under 35 U.S.C. 154(b) by 0 days.

(21) Appl. No.: 11/881,587

(22) Filed: Jul. 27, 2007

(65) Prior Publication Data

US 2009/0025542 A1 Jan. 29, 2009

(51) Int. Cl.
*G10H 1/02* (2006.01)
*G10H 6/00* (2006.01)

(52) U.S. Cl. ..... 84/663

(58) Field of Classification Search ..... 84/626, 84/627, 662, 663
See application file for complete search history.

(56) References Cited

U.S. PATENT DOCUMENTS 4,704,682 A 11/1987 Clynes ..... 364/419
4,763,257 A 8/1988 Clynes ..... 364/419
4,999,773 A 3/1991 Clynes ..... 364/419
5,305,423 A 4/1994 Clynes ..... 395/2.67
5,559,927 A 9/1996 Clynes ..... 395/267
6,924,426 B2 8/2005 Clynes ..... 84/609

*Primary Examiner*—Jeffrey Donels
(74) *Attorney, Agent, or Firm*—Greenberg Traurig, LLP

(57) ABSTRACT

Methods and apparatus, including computer program products, for shaping amplitude contours of musical notes. A method for shaping amplitude contours of musical notes in time of particular pitch and duration includes processing musical notes to modify a contour of an amplitude shape curve of each note differently in accordance with its relationship to its succeeding note, the processing including calculating an initial amplitude shape curve, modifying a first portion of the calculated initial amplitude shape curve to be more convex or more concave, and independently modifying a second portion of the calculated initial amplitude shape curve to be more convex or more concave, the resulting modifications improving a timbre quality.

17 Claims, 3 Drawing Sheets

SHAPING AMPLITUDE CONTOURS OF MUSICAL NOTES

BACKGROUND

The present invention relates to data processing by digital computer, and more particularly to shaping amplitude contours of musical notes.

In music, musical notes, i.e., tones, may be struck, like they are on a piano, giving a limited opportunity for changing an amplitude shape once a note has been struck by a piano hammer that strikes the strings. A similar limitation applies to notes plucked on a harpsichord or struck on percussive instruments. Greater expressiveness on a violin is achieved as the two arms and fingers are used to control one note at a time, which enables a note to rise and decay gradually, with near unlimited variability, giving rise to the possibility of great eloquence, as well as providing difficulty of control. The human voice, the best instrument of all, has this ability, but can only sing one note at a time.

All instruments that can shape a single tone as a function of time require, for a musical effect, that it be done with appropriate discrimination and control. Only then can the emotional quality and meaning of the music be realized. The shapes of notes are individually and differentially controlled. While this is not the only parameter that serves the expressive needs of music, it is one of the important ones. Small changes in shape of single notes of a melody, or of several notes, can alter the meaning of music. Moreover, the amplitude shapes of notes, varying individually, do so in a way to achieve musical meaning.

SUMMARY

The present invention provides methods and apparatus, including computer program products, for shaping the varying amplitude contours of musical notes in a musically meaningful manner.

In an aspect, the invention features a method for shaping amplitude contours of musical notes in time of particular pitch and duration, the method including processing musical notes to modify a contour of an amplitude shape curve of each note differently in accordance with its relationship to its succeeding note, the processing including calculating an initial amplitude shape curve using a function, and modifying the initial amplitude shape curve using the same function to generate a corrected amplitude shape curve.

In embodiments, modifying the initial amplitude shape curve can include determining a peak of the initial amplitude shape curve, modifying a pre-peak portion of the initial amplitude shape curve, and modifying a post-peak portion of the initial amplitude shape curve.

Modifying the pre-peak portion can include collapsing the initial amplitude shape curve in time to fit the pre-peak portion from a beginning of the initial amplitude shape curve to the peak of the initial amplitude shape curve, and adding the collapsed initial amplitude shape curve to or subtracting the collapsed initial amplitude shape curve from the pre-peak portion in a small proportion of a size of the initial amplitude shape curve. The small proportion can be user-selectable.

Modifying the post-peak portion can include collapsing the initial amplitude shape curve in time to fit the post-peak portion from the peak of the initial amplitude shape curve to an end of the initial amplitude shape curve, and adding the collapsed initial amplitude shape curve to or subtracting the collapsed initial amplitude shape curve from the post-peak portion in a small proportion of a size of the initial amplitude shape curve. The small proportion can be user-selectable.

The function can be a beta function that is defined as $x^{P1}(1-x)^{P2}$ for $0 \leqq x \leqq 1$ normalized to unity maximum by $$N = \frac{p_1^{p_1} p_2^{p_2}}{(p_1 + p_2)^{(p_1+p_2)}}$$

giving an amplitude envelope shape as a function of time t, (0<t<T)

giving an initial shape $$A(t) = \frac{G}{N}\left(\frac{t}{T}\right)^{p_1} * \left(1 - \frac{t}{T}\right)^{p_2}$$

for a note of duration T and amplitude G.

$P_1$ and $P_2$ can be given by a relationship that relates semitone number steps and duration from a first note to a succeeding note T to the $P_1$ and $P_2$ values used in the beta function.

The relationship can be $P_1 = P_{1(m)} e^{bs\ exp(-aT)}$ and $P_2 = P_{2(m)} e^{-bs\ exp(-aT)}$.

s can represent the number of semitones to the next note, a can represent a modulation scaling constant of $P_{1,2}$ by duration, b can represent a modulation scaling constant of $P_{1,2}$ by frequency, T can be the duration of the present tone in milliseconds, and $P_{1(m)}$, $P_{2(m)}$ can represent base values of $P_1$ and $P_2$.

In another aspect, the invention features a method for shaping amplitude contours of musical notes in time of particular pitch and duration, the method including processing musical notes to modify a contour of an amplitude shape curve of each note differently in accordance with its relationship to its succeeding note, the processing including calculating an initial amplitude shape curve using a beta function, and modifying the initial amplitude shape curve using the same beta function to generate a corrected amplitude shape curve.

In embodiments, modifying the initial amplitude shape curve can include determining a peak of the initial amplitude shape curve, collapsing the initial amplitude shape curve in time to fit a pre-peak portion from a beginning of the initial amplitude shape curve to the peak of the initial amplitude shape curve, adding the collapsed initial amplitude shape curve to or subtracting the collapsed initial amplitude shape curve from the pre-peak portion, collapsing the initial amplitude shape curve in time to fit a post-peak portion from the peak of the initial amplitude shape curve to an end of the initial amplitude shape curve, and adding the collapsed initial amplitude shape curve to or subtracting the collapsed initial amplitude shape curve from the post-peak portion.

The beta function can be defined as $x^{P1}(1-x)^{P2}$ for $0 \leqq x \leqq 1$ normalized to unity maximum by $$N = \frac{p_1^{p_1} p_2^{p_2}}{(p_1 + p_2)^{(p_1+p_2)}}$$

giving an amplitude envelope shape as a function of time t, (0<t<T)

giving an initial shape $$A(t) = \frac{G}{N}\left(\frac{t}{T}\right)^{p_1} * \left(1 - \frac{t}{T}\right)^{p_2}$$

for a note of duration T and amplitude G.

$P_1$ and $P_2$ can be given by a relationship that relates semitone number steps and duration from a first note to a succeeding note T to the $P_1$ and $P_2$ values used in the beta function.

The relationship can be $P_1=P_{1(m)}e^{bs\ exp(-aT)}$ and $P_2=P_{2(m)}e^{-bs\ exp(-aT)}$.

s can represent the number of semitones to the next note, a can represent a modulation scaling constant of $P_{1,2}$ by duration, b can represent a modulation scaling constant of $P_{1,2}$ by frequency, T can be the duration of the present tone in milliseconds, and $P_{1(m)}$, $P_{2(m)}$ can represent the base values of $P_1$ and $P_2$.

In still another aspect, the invention feature a method for shaping amplitude contours of musical notes in time of particular pitch and duration, the method including processing musical notes to modify a contour of an amplitude shape curve of each note differently in accordance with its relationship to its succeeding note, the processing including calculating an initial amplitude shape curve, modifying a first portion of the calculated initial amplitude shape curve to be more convex or more concave, and independently modifying a second portion of the calculated initial amplitude shape curve to be more convex or more concave, the resulting modifications improving a timbre quality.

In embodiments, the calculating and the modifying use a single beta function.

The first portion can represent a pre-peak portion of the calculated initial amplitude shape curve from its beginning to its peak. The second portion can represent a post-peak portion of the calculated initial amplitude shape curve from its peak to its end.

Modifying the first portion can include collapsing the calculated initial amplitude shape curve in time to fit the pre-peak portion, and adding the collapsed initial amplitude shape curve to or subtracting the collapsed initial amplitude shape curve from the pre-peak portion in a small proportion of a size of the calculated initial amplitude shape curve. The small proportion can be user-selectable.

Modifying the second portion can include collapsing the calculated initial amplitude shape curve in time to fit the post-peak portion, and adding the collapsed initial amplitude shape curve to or subtracting the collapsed initial amplitude shape curve from the post-peak portion in a small proportion of a size of the calculated initial amplitude shape curve. The small proportion can be user-selectable.

The invention can be implemented to realize one or more of the following advantages.

A method decides on a shape of a present note depending on what note follows next, i.e., a present shape depends on what follows and when. The method anticipates what happens next in a certain way.

The method enables a shape of a present note to indirectly suggest what follows.

The method enables an ability to add or subtract to or from separate portions of calculated amplitude curves independently, providing greater differentiation of sound and general expressiveness. This permits a choice of a harsher or milder, or "sweeter" tone quality as desired, of the particular notes. Each note can receive its own shaping modification setting, enabling the various instruments in an ensemble such as a quartet or an orchestra, to each have their own more individual character, and change of character. These settings can be changed for different parts of the music in subtle new ways that add to a total expressiveness and meaning of the music.

The method extends the variability and suitability of a family of amplitude contour shapes and improves a timbre quality so that the result can be of greater naturalness, becoming almost indistinguishable from that produced by an artistic human player.

The method can enable the predictive aspect of the amplitude shaping of a present word or phrase of speech depending on what words of speech follows next, intended to be emphasized, or deemphasized, as the case may be.

One implementation of the invention can provide all of the above advantages.

Other features and advantages of the invention are apparent from the following description, and from the claims.

BRIEF DESCRIPTION OF THE DRAWINGS

Like reference numbers and designations in the various drawings indicate like elements.

DETAILED DESCRIPTION

Figure 1:
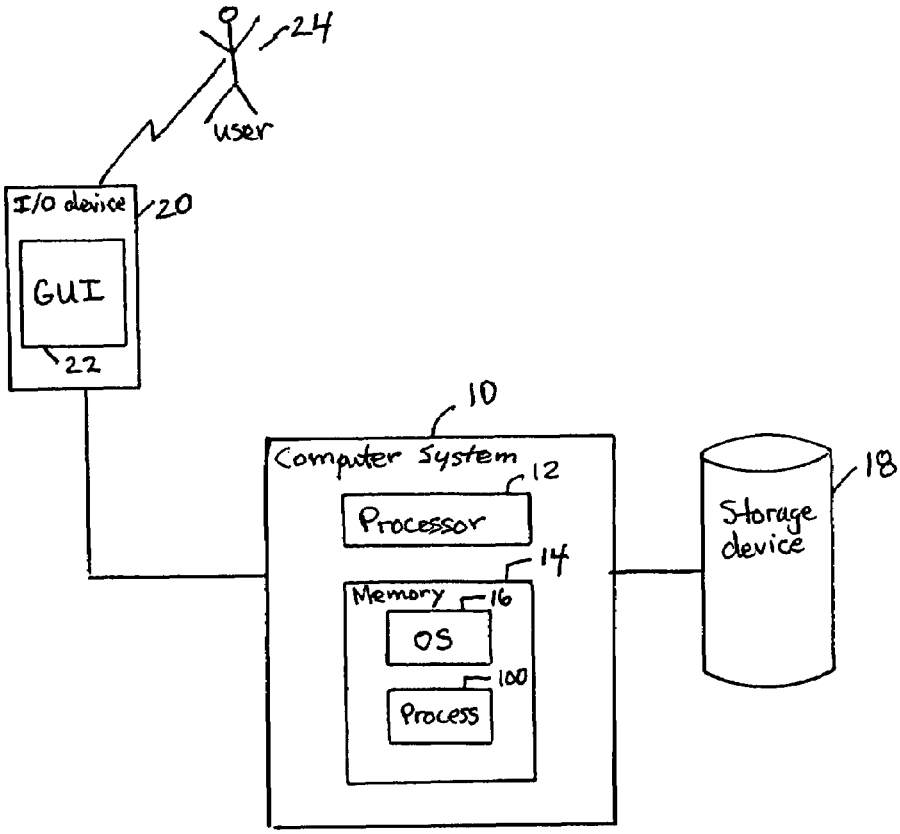
FIG. 1 is a block diagram of an exemplary data processing system.

As shown in FIG. 1, an exemplary computer system 10 includes a processor 12 and memory 14. Memory 14 can include an operating system (OS) 16, such as Linux, Windows, or Apple, and a process 100 that uses a beta function to calculate individual tone shapes, fully described below. In process 100, a shape is calculated with beta functions and then corrections are applied to generate a final shape. In process 100, the amplitude character of a tone is specified by three numbers, respectively denoting the amplitude magnitude G, and parameters $P_1$ and $P_2$.

The system 10 may include a storage device 18 and input/output (I/O) device 20 for display of a graphical user interface (GUI) 22 to a user 24.

All instruments that can shape a single tone as a function of time require that this be done with appropriate discrimination and control for a musical effect. Only then can the emotional quality of the music become well realized to a degree that the shapes of notes are individually and differentially controlled. While this is not the only parameter that serves the expressive needs of music, it is one of the primary ones. Small changes in a shape of single note in a melody can significantly alter the meaning of the music.

When notes are organized in a sequence to form a melody, it becomes important to shape the individual tones variously and in a well-suited manner for the musical expression to have an intended meaning. The meaning can be easily destroyed by employing a false shape for a note even if the correct note is played at the correct time.

Like many aspects of real music, the correct shape for a given tone in a given melody is not indicated in the score by the composer. Rather, the correct shape is imagined by the performer (e.g., violinist, cellist, flutist or the singer) and performed accordingly. To be able to do this well is at the heart of music. It is not easy to teach and certainly not easy to teach to the necessary precision.

If a computer, such as system 10, performs music, the computer must be instructed. Laws of musicality represent a systematic way in which a musical brain requires shaping to occur, depending on the musical structure, and on expressiveness.

The need for shaping was recognized, albeit inadequately, by the music industry in generating Musical Instrument Digital Interface (MIDI) files. MIDI is an electronic communications protocol that enables electronic musical instruments, computers and other equipment to communicate, control and synchronize with each other in real time. MIDI addressed the problem by modeling the tones on a piano action, represented by particular parameters for an Attack, Decay, Sustain and Release (ADSR).

In general, an ADSR envelope is a method of many synthesizers, samplers, and other electronic musical instruments. The ADSR envelope may be a discrete circuit or module (in the case of analog devices), or implemented as part of the computer's software (in the case of digital devices).

In ADSR, "Attack" refers to how quickly the sound reaches full volume after the sound is activated (e.g., the key is pressed). "Decay" refers to how quickly the sound drops to the sustain level after the initial peak. "Sustain" refers to the "constant" volume that the sound takes after decay until the note is released. i.e., a volume level rather than a time period. "Release" refers to how quickly the sound fades when a note ends (the key is released).

ADSR can be applied to violins and other instruments. Using a uniform value for the four ADSR parameters has been a common solution that resulted in a highly unmusical result. One problem not addressed by ADSR is that ADSR parameter values are independent of the duration of the note. MIDI is constructed such that the duration of the note is not available at the beginning of the note, only provided at its end, thus enabling improvisation. This makes the Attack, Decay and Sustain independent of the duration of the note, an exceedingly poor principle.

To overcome some of the rigidity, it is possible to have more than four parameters to define a shape of a note by a series of straight line segments. MIDI masters eventually became adept at manually designing each of the individual note shapes on artistic grounds, thereby inflating the interpretative process to a very large number of hours for a given result, sometimes taking up to a year or more for a major musical composition. Even then MIDI performances lack attributes required by the music, such as individually designed vibrato, and suitable variation in timbres. To help with this, huge banks or archives of samples were built so that shapes could be chosen as required from this archive, made by a variety of instrumental modes, bowings, attacks and so forth.

Laws of musicality however applied to shaping enable a computer to produce globally musical results. These laws of musicality can be realized in computer processes and result in a music interpretation program, such as Superconductor® from Microsound International of Sonoma, Calif., which largely meets the necessary realization of musical qualities and expressiveness, directed by human global, sectional or individual choice within the music interpretive process.

The laws of musicality that underlie the functionality of shaping are described as follows:

First, a note cannot be represented by ADSR as a four straight line segmented shape including a cornered damper phase modeled on mechanical piano action; a note instead has a rounded shape, without discontinuities.

Second, the family of shapes used by the musical mind can be represented by a family of beta functions.

Third, a basic shape is designed for a given musical "voice" using beta functions having two tunable parameters, $P_1$ and $P_2$, which select a shape from the family of beta functions.

Fourth, this shape is applied to all tones of the voice, regardless of their duration. That is, the shape is stretched from the beginning of the tone to its end, i.e., compressed for short tones and expanded for long ones. This is a major improvement over the dominant technology.

Fifth, the shape on every tone is skewed forward or backward according to what note is expected to occur next and when. The slope of the tangent drawn to the pitch time curve of the melody at that note to the start of the next note determines how much the basic shape is skewed forward or backward.

In order to produce convenient shapes for amplitude-modulating individual tones, a mathematical beta function is employed. The beta function permits generation of a wide variety of shapes with the aid of only tunable two parameters, i.e., $P_1$ and $P_2$, which has a considerably wider applicable scope than the use of multiple exponentials.

As described above, in electronic generation of musical sounds, it has been typical to specify tones using parameters of Attack, Decay, Sustain, Release and final Decay, or some subset of these. These ADSR parameters, devised by electronic engineers, do not really have an appropriate musical function in the large majority of instances. Tones of music hardly ever have a sustained plateau. Separation of portions of a tone into a decay and a release phase is generally the result of mechanical properties of piano dampers and not a musical requirement.

Varied rounded forms available through the beta function enable a simple and time-economical realization of a multitude of nuances of musical tone amplitude forms. The name "beta function" derives from a similar function used in mathematical statistics, but is not the same function as used by statisticians. The beta function as used here is the argument of integration of the statistician's beta function, without the integration. The beta function used here is defined as:

$x^{P1}(1-x)^{P2}$ for $0 \leqq x \leqq 1$ and is normalized for a maximum amplitude of 1 by dividing by a constant N:

$$N = \frac{p_1^{p_1} p_2^{p_2}}{(p_1 + p_2)^{(p_1+p_2)}}$$

for a particular set of values of $P_1$ and $P_2$ ($P_1, P_2 \geqq 0$). The resulting shape is multiplied by a parameter G to give the amplitude size of the particular tone. The shape stretches over a number of points determined by the duration of the tone. Thus, the amplitude envelope as a function of time, A(t), of a tone of duration T is given by ($0<t<T$):

$$A(t) = \frac{G}{N}\left(\frac{t}{T}\right)^{p_1} * \left(1 - \frac{t}{T}\right)^{p_2}$$

Each tone has its own $P_1$ and $P_2$ values that determine its shape. $P_{1(m)}$ and $P_{2(m)}$, the base shape values, are chosen to fit the character of the music. For example, by choosing suitable values of $P_1$ and $P_2$, a shape may be selected from families of shapes. Choosing the value 1 for both parameters $P_1$, $P_2$ gives rise to a symmetrical, rounded form, and 0.89 for both parameters $P_1$, $P_2$ produces a form very close to a sine half wave. Smaller values of $P_1$ result in steeper rises; zero being a step function. Larger values than 1 for either $P_1$ or $P_2$ make the curve concave, at the corresponding regions. A combination of zero and 1 results in a saw tooth shape.

Most commonly used P values for musical tones generally lie within the region of 0.5 to 5, and most frequently in the region of 0.7 to 2. Where required, a second or several more beta functions may be added to produce the desired shape.

There are a wide family of curves specified by the parameters $P_1$ and $P_2$, which encompasses the shapes of notes encountered. A basic shape is chosen for a particular voice ($P_{1(m)}$, $P_{2(m)}$), placed on each note, and skewed forward or backward on the note depending on the slope of the pitch time curve from the present note to the next note. The shape of each note is then given by A(t) with values of $P_1$ and $P_2$ determined according to $P_1=P_{1(m)}e^{bs\,exp(-aT)}$, $P_2=P_{2(m)}e^{-bs\,exp(-aT)}$, where s=the number of semitones to the next note, a=modulation scaling constant of $P_{1,2}$ by duration (typically 0.00269 $ms^{-1}$), b=modulation scaling constant of $P_{1,2}$ by frequency (typically 0.20 $semitone^{-1}$), T is the duration of the present tone in milliseconds, and $P_{1(m)}$, $P_{2(m)}$=base values of $P_1$ and $P_2$. a and b are typically small, such as 00269 $ms^{-1}$ and 0.20 $semitone^{-1}$, for example.

The modified shape implicitly predicts what is to follow, similar to how, in the flow of speech, the form of a syllable predicts how the next syllable might be formed. This engenders a sense of continuity, each expectation being capable of fulfillment.

Applying these equations and principals to the voices of music results in phrasing that is subtly and globally controllable by the composer or interpreter. It may be combined with the principle of composer's hierarchic pulse, to generate highly expressive and appropriate phrasing.

While the beta function has been useful in enabling interpretations of many works of music, process 100 improves amplitude shapes further that give music its full and natural eloquence.

One particular limitation of the above beta function is that shapes end in a convex manner, which makes it difficult to achieve the kind of diminuendo on single notes that musician Pablo Casals called "diminuendo to infinity." And at the beginning of the tones, the rise of the amplitude curves, while suitably varying, are limited in their ability to represent a necessary roughness at times, as sometimes required in the musical sense.

Another effect of shaping is its relation to timbre. Timbre is caused by the fact that each note from a musical instrument is a complex wave containing more than one frequency. For instruments that produce notes with a clear and specific pitch, the frequencies involved are mostly part of a harmonic series. For other instruments (such as drums), the sound wave may have an even greater variety of frequencies. We hear each mixture of frequencies in their time courses not as separate sounds, but as the color of the sound. Small differences in the balance of the frequencies (e.g., how many you can hear, their relationship to the fundamental pitch, and how loud they are compared to each other, and most particularly, their time course (which is different for the different harmonics)), generate the many different musical colors. The harmonics and their time course at the beginning of each note, i.e., the attack, are especially important for timbre, so it is actually easier to identify instruments that are playing short notes with strong articulations than it is to identify instruments playing long, smooth notes.

The human ear and brain are capable of hearing and appreciating very small variations in timbre. A listener can hear not only the difference between an oboe and a flute, but also the difference between two different oboes. The general sound that one would expect of a type of instrument, e.g., a trombone, is usually called its timbre or color. Variations in timbre between specific instruments—two different trombones, for example, or two different trombone players, or the same trombone player using different types of sound in different pieces—may be called differences in timbre or color, or may be called differences in tone or in tone quality. Tone quality may refer to, for example, "quality," as when a young trombonist is encouraged to have a "fuller" or "more focused" tone quality, or it can refer neutrally to differences in sound, as when an orchestral trombonist is asked to play with a "brassy" tone quality in one passage and a "mellow" tone quality in another.

Although note shapes (as amplitude envelopes, as a waveform in its own right) are all in the sub-audible timing range, typically between 0.2 seconds and 2.0 seconds long, the harmonics (sidebands) of these shapes cause sidebands that do affect the effective timbre of the note. This is an unexpected but helpful consequence. The timbre changes on the notes produce a very natural and musical effect, such as real violinists, instrumentalists or singers produce. It may be that much of the varying timbre effects of natural performances lie in the shaping of the tones rather than the character of the instrument itself. In fact, the use of beta functions for varyingly shaping the tones produce a helpful and natural timbre varying effect, adding to the naturalness of the music produced.

Process 100 extends the variability and suitability of the family of shapes and improves the timbre quality so that the result is a greater naturalness. The sound becomes virtually indistinguishable from that produced by a human player playing a traditional instrument.

Process 100 achieves extension and increased naturalness. Process 100 uses the beta function family in an entirely new and different manner. In short, the original amplitude curve of a note is collapsed, i.e., contracted horizontally to a first portion of the original amplitude curve and separately to a second portion of the original amplitude curve. These two separate contracted forms are typically of different duration. These two separate contracted forms are then added to or subtracted from corresponding portions of the original amplitude curve, as fully described below.

Figure 2:
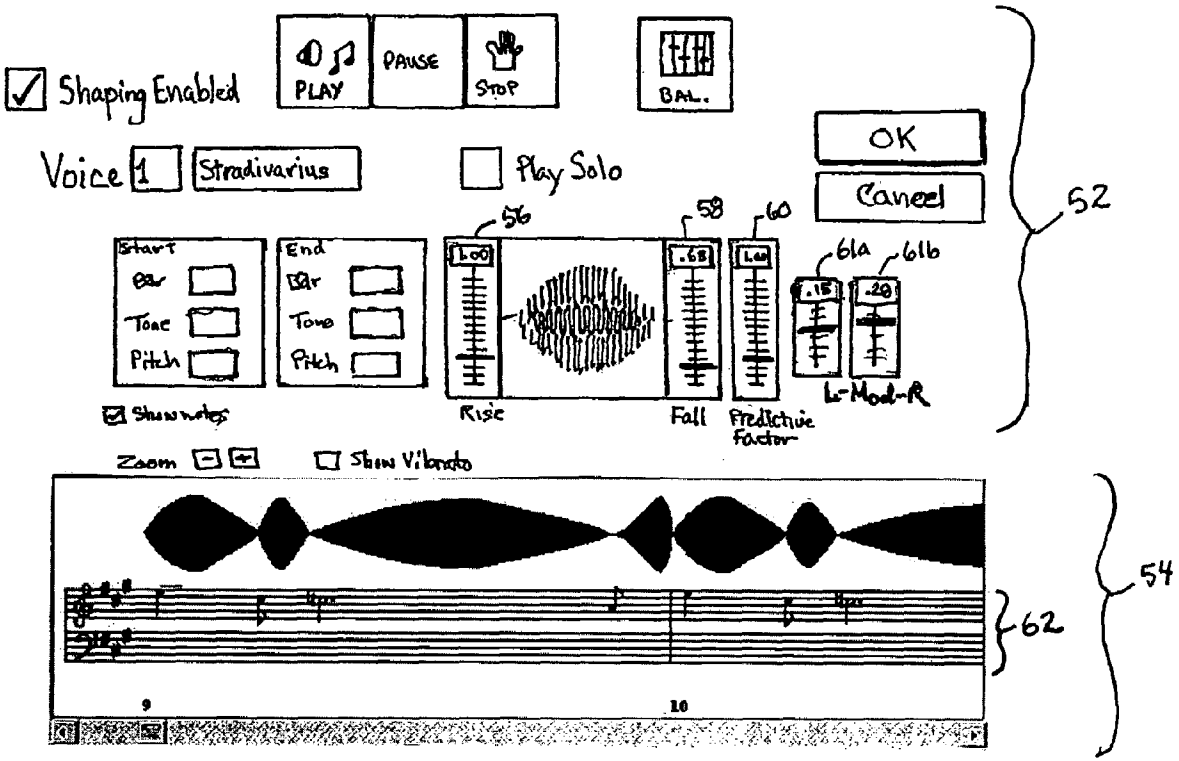
FIG. 2 is a block diagram of an exemplary graphical user interface (GUI).

As shown in FIG. 2, an exemplary note shaping graphical user interface (GUI) 50 includes a control region 52 and a graphics region 54. The control region 52 includes a rise slider 56, a fall slider 58, a predictive factor slider 60 and L-Mod-R sliders 61*a*, 61*b* that enable a user to chose an amount to be subtracted from a region, or added, as described below. In this particular example, a musical score 62 in the graphics region 54 includes seven musical notes. In this particular example, L-Mod-R slider 61*a* is set to −0.15 and slider 61*b* set to 0.28. Included in the graphics region 54 is a shape corresponding to each of the seven musical notes in the musical score 62 that result from these L-Mod-R slider settings.

Figure 3:
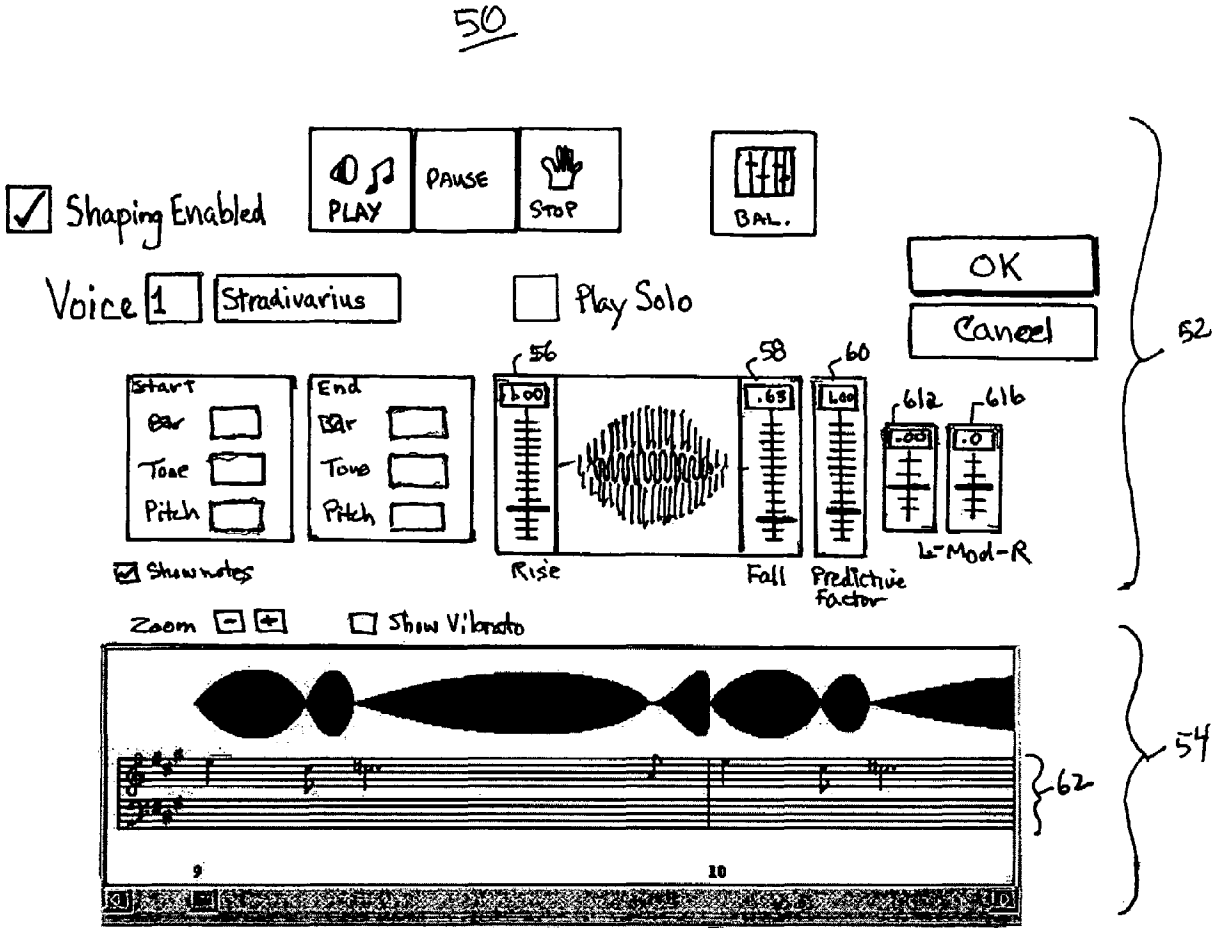
FIG. 3 is a block diagram of an exemplary GUI.

As shown in FIG. 3, the graphics region 54 shows the resultant shape corresponding to the seven notes in the musical score 62 resulting when the L-Mod-R slider 61*a* is set to 0.00 and 61*b* is set to 0.0.

Each shape curve is considered to have a starting point, a midpoint (or high point), and an ending point. Process 100 treats a first (i.e., pre-peak) portion of a shape curve separately from a second (i.e., post-peak) portion of the shape curve. Here the pre-peak portion S1 is defined as a portion of the shape curve from the starting point to the high point. The post-peak portion S2 is defined as a portion of the shape curve from the high point to the ending point.

More particularly, for each note, process 100 determines a high point ($P_1/(P_1+P_2)$) of the original shape curve calculated with the beta function and subsequently processes the first (pre-peak) portion S1 (i.e., starting point to high point) separately from the second (post-peak) portion S2 (i.e., high point to the ending point) to generate a corrected shape. The total shape S is collapsed to cover the time of the pre-peak portion S1. Separately, the total shape S is collapsed to cover the time of the post-peak portion S2. The two different collapsed shapes, Sc1 and Sc2, can be added to or subtracted from the pre-peak portion S1 and the post-peak portion S2, respectively, by proportional amounts, depending on respective slider 61*a*, 61*b* settings (i.e., collapsed shape Sc1 modifying the pre-peak portion S1 and collapsed shape Sc2 modifying the post-peak portion S2). The sliders 61*a*, 61*b* enable user-selectable inputs or settings for the modifications.

If collapsed shape Sc2 is subtracted from the post-peak portion S2, the resultant contour shape has a more concave ending. By adding collapsed shape Sc2 to the post-peak portion S2 in an adjustable amount, the termination is made more abrupt.

In a similar fashion, collapsed shape Sc1 can added to or subtracted from the pre-peak portion S1, to effectuate a more aggressive or less aggressive beginning of the tone, in a varying amount according to the slider 61*a*, 61*b* settings.

Since all the shapes vary according to a tangent to the next note rule, the additions and subtractions are modifications distinct according to the skewing. The skewing affects the relative values of the pre-peak portion S1 and the post-peak portion S2, and thus the distances to which the total shape S is collapsed, and not only preserves the individuation of the tones, but makes them even more distinct.

In process 100, an original shape is first calculated with the beta functions and then corrections applied. Since the corrections use exactly the same shape, no further beta function calculation is required, only collapsing of the already calculated shape. This makes process 100 both an elegant solution and economical in its needs of computer power.

Process 100 uses the same $P_1$, $P_2$ shape regardless of the duration of the note, contrary to MIDI and ADSR. This means that the shape is drawn across each note. Since notes are of different durations, the shape will be stretched or more contracted depending on the duration of the note.

The ability to add or subtract independently of pre-peak portion S1 and the post-peak portion S2, collapsed from their original forms, enables still greater differentiation of sound and general expressiveness, permitting a choice of a harsher, milder or "sweeter" tone quality as desired of that particular music. Each musical piece, or portion of a piece, can receive its unique shaping modification setting, thus permitting the various instruments in an ensemble, such as a quartet or an orchestra, to each have their own more individual character, and change of character (as these settings can be changed for different parts of the music) in subtle new ways that add to the total expressiveness and meaning of the music.

In practice, the additions or subtractions are very sensitive and only a small fraction of the collapsed shapes, typically 3.0% to 25.0%, need to be added or subtracted to give desired effects.

In one specific example, the second "half" is subtracted from the original and the first "half" added as a default condition. Each of the two modifications has its own slider 61*a*, 61*b* so that each individual voice or instrument can receive its own proportioned modification, for all the notes of the entire piece.

Alternatively, the modifications can be effectuated for a limited range of bars or notes only, on any voice.

Typically, a post-peak portion is subtracted, making the shape more concave, and the pre-peak portion is added, making the initial rise steeper.

By choosing appropriate positive and negative amounts for the respective pre-peak and post-peak modifications, the resulting shapes are made more concave, resulting in "diminuendos to infinity," and also independently can be made more assertive by adding to the pre-peak portion of the shape, to a desired degree. This is effected varyingly for all the notes according to the predictive equations, maintaining an important organic unity throughout, both in the original and the modifying forms. The single slider settings modify all the notes individually but differently, according to the equations stated.

These shape modifications are made for all notes of the music automatically and are additive to the function of modifying a shape according to the predictive function in U.S. Pat. No. 4,999,773, incorporated herein by reference in its entirety. Now the total shape, as well as the modifications, are involved (i.e., tilted forwards or backwards). Individual notes are still treated individually, including the individual modifications, which are themselves individually different.

The effect of the modifications is clearly audible and represents an important improvement. The use of the same shape, as specifically collapsed, in its calculations makes it easy for process 100 to execute with little computer resource requirements.

By using the same shape for defining the modification, albeit collapsed in time, a certain organic unity or integrity is maintained, a property that may be artistically important. This integrity is subtle and not readily measurable and perhaps even researchable, but nevertheless seems clearly artistically meaningful.

The method is typically applied to all the voices of the music, with different base settings of $P_1$ and $P_2$ chosen for different instruments. The computer can readily calculate all the tone amplitude shapes in real time for all the voices, for an orchestral, chamber music or solo, or band performance, as played by the computer, or as conducted in accordance with a current patent disclosure and application.

Embodiments of the invention can be implemented in digital electronic circuitry, or in computer hardware, firmware, software, or in combinations of them. Embodiments of the invention can be implemented as a computer program product, i.e., a computer program tangibly embodied in an information carrier, e.g., in a machine readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand alone program or as a module, component, subroutine, or other unit suitable for use in a computing environment. A computer program can be deployed to be executed on one computer or on multiple computers at one site or distributed across multiple sites and interconnected by a communication network.

Method steps of embodiments of the invention can be performed by one or more programmable processors executing a computer program to perform functions of the invention by operating on input data and generating output. Method steps can also be performed by, and apparatus of the invention can be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. Information carriers suitable for embodying computer program instructions and data include all forms of non volatile memory, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in special purpose logic circuitry.

It is to be understood that the foregoing description is intended to illustrate and not to limit the scope of the invention, which is defined by the scope of the appended claims. Other embodiments are within the scope of the following claims.

What is claimed is:

1. A method for shaping amplitude contours of musical notes in time of particular pitch and duration, the method comprising:

processing musical notes to modify a contour of an amplitude shape curve of each note differently in accordance with its relationship to its succeeding note, the processing comprising:

calculating an initial amplitude shape curve using a function; and modifying the initial amplitude shape curve using the same function to generate a corrected amplitude shape curve, the modifying comprising determining a peak of the initial amplitude shape curve, modifying a pre-peak portion of the initial amplitude shape curve, and modifying a post-peak portion of the initial amplitude shape curve, the modifying the pre-peak portion comprising collapsing the initial amplitude shape curve in time to fit the pre-peak portion from a beginning of the initial amplitude shape curve to the peak of the initial amplitude shape curve, and adding the collapsed initial amplitude shape curve to or subtracting the collapsed initial amplitude shape curve from the pre-peak portion in a small proportion of a size of the initial amplitude shape curve.

2. The method of claim 1 wherein the small proportion is user-selectable.

3. The method of claim 1 wherein modifying the post-peak portion comprises:

collapsing the initial amplitude shape curve in time to fit the post-peak portion from the peak of the initial amplitude shape curve to an end of the initial amplitude shape curve; and adding the collapsed initial amplitude shape curve to or subtracting the collapsed initial amplitude shape curve from the post-peak portion in a small proportion of a size of the initial amplitude shape curve.

4. The method of claim 3 wherein the small proportion is user-selectable.

5. The method of claim 1 wherein the function is a beta function that is defined as $x^{P1}(1-x)^{P2}$ for $0 \leqq x \leqq 1$ normalized to unity maximum by $$N = \frac{p_1^{p_1} p_2^{p_2}}{(p_1 + p_2)^{(p_1+p_2)}}$$

giving an amplitude envelope shape as a function of time t, (0<t<T)

giving an initial shape $$A(t) = \frac{G}{N}\left(\frac{t}{T}\right)^{p_1} * \left(1 - \frac{t}{T}\right)^{p_2}$$

for a note of duration T and amplitude G.

6. The method of claim 5 wherein $P_1$ and $P_2$ are given by a relationship that relates semitone number steps and duration from a first note to a succeeding note T to the $P_1$ and $P_2$ values used in the beta function.

7. The method of claim 6 wherein the relationship is $P_1 = P_{1(m)}e^{bs\ exp(-aT)}$ and $P_2 = P_{2(m)}e^{-bs\ exp(-aT)}$.

8. The method of 7 wherein s represents the number of semitones to the next note, a represents a modulation scaling constant of $P_{1,2}$ by duration, b represents a modulation scaling constant of $P_{1,2}$ by frequency, T is the duration of the present tone in milliseconds, and $P_{1(m)}$, $P_{2(m)}$ represent base values of $P_1$ and $P_2$.

9. A method for shaping amplitude contours of musical notes in time of particular pitch and duration, the method comprising:

processing musical notes to modify a contour of an amplitude shape curve of each note differently in accordance with its relationship to its succeeding note, the processing comprising:

calculating an initial amplitude shape curve using a beta function; and modifying the initial amplitude shape curve using the same beta function to generate a corrected amplitude shape curve, modifying the initial amplitude shape curve comprising determining a peak of the initial amplitude shape curve, collapsing the initial amplitude shape curve in time to fit a pre-peak portion from a beginning of the initial amplitude shape curve to the peak of the initial amplitude shape curve, adding the collapsed initial amplitude shape curve to or subtracting the collapsed initial amplitude shape curve from the pre-peak portion, collapsing the initial amplitude shape curve in time to fit a post-peak portion from the peak of the initial amplitude shape curve to an end of the initial amplitude shape curve, and adding the collapsed initial amplitude shape curve to or subtracting the collapsed initial amplitude shape curve from the post-peak portion.

10. The method of claim 9 wherein the beta function is defined as $x^{P1}(1-y)^{P2}$ for $0 \leqq x \leqq 1$ normalized to unity maximum by $$N = \frac{p_1^{p_1} p_2^{p_2}}{(p_1 + p_2)^{(p_1+p_2)}}$$

giving an amplitude envelope shape as a function of time t, (0<t<T)

giving an initial shape $$A(t) = \frac{G}{N}\left(\frac{t}{T}\right)^{p_1} * \left(1 - \frac{t}{T}\right)^{p_2}$$

for a note of duration T and amplitude G.

11. The method of claim 10 wherein $P_1$ and $P_2$ are given by a relationship that relates semitone number steps and duration from a first note to a succeeding note T to the P1 and P2 values used in the beta function.

12. The method of claim 11 wherein the relationship is $P_1 = P_{1(m)}e^{bs\ exp(-aT)}$ and $P_2 = P_{2(m)}e^{-bs\ exp(-aT)}$.

13. The method of 12 wherein s represents the number of semitones to the next note, a represents a modulation scaling constant of $P_{1,2}$ by duration, b represents a modulation scaling constant of $P_{1,2}$ by frequency, T is the duration of the present tone in milliseconds, and $P_{1(m)}$, $P_{2(m)}$ represent base values of $P_1$ and $P_2$.

14. A method for shaping amplitude contours of musical notes in time of particular pitch and duration, the method comprising:

processing musical notes to modify a contour of an amplitude shape curve of each note differently in accordance with its relationship to its succeeding note, the processing comprising:

calculating an initial amplitude shape curve;

modifying a first portion of the calculated initial amplitude shape curve to be more convex or more concave, modifying the first portion comprising collapsing the calculated initial amplitude shape curve in time to fit the pre-peak portion and adding the collapsed initial amplitude shape curve to or subtracting the collapsed initial amplitude shape curve from the pre-peak portion in a small proportion of a size of the calculated initial amplitude shape curve; and independently modifying a second portion of the calculated initial amplitude shape curve to be more convex or more concave, the resulting modifications improving a timbre quality.

15. The method of claim 14 wherein the small proportion is user-selectable.

16. The method of claim 14 wherein modifying the second portion comprises:

collapsing the calculated initial amplitude shape curve in time to fit the post-peak portion; and adding the collapsed initial amplitude shape curve to or subtracting the collapsed initial amplitude shape curve from the post-peak portion in a small proportion of a size of the calculated initial amplitude shape curve.

17. The method of claim 16 wherein the small proportion is user-selectable.

* * * * *